US005937931A

United States Patent [19]

Hässig

[11] Patent Number: 5,937,931

[45] Date of Patent: Aug. 17, 1999

[54] LOW-PRESSURE DIE CASTING PLANT

[75] Inventor: Harry Hässig, Teufenthal, Switzerland

[73] Assignee: KWC AG, Unterkulm, Switzerland

[21] Appl. No.: 08/912,871

[22] Filed: Aug. 19, 1997

[30] Foreign Application Priority Data

Aug. 23, 1996 [CH] Switzerland ..... 2075/96

[51] Int. Cl.[6] ..... B22D 18/04; B22D 33/00; B22D 47/00

[52] U.S. Cl. ..... 164/267; 164/306; 164/323; 164/340

[58] Field of Search ..... 164/158, 267, 164/306, 309, 322, 323, 340

[56] References Cited

U.S. PATENT DOCUMENTS

| | | | |
|---|---|---|---|
| 3,512,576 | 5/1970 | Plume et al. | 164/306 X |
| 3,804,152 | 4/1974 | Cook et al. | 164/306 |
| 4,425,958 | 1/1984 | Luthy et al. . | |
| 4,431,046 | 2/1984 | Phillips . | |
| 5,205,341 | 4/1993 | Treul et al. | 164/306 |

FOREIGN PATENT DOCUMENTS

| | | | |
|---|---|---|---|
| 0175833 | 4/1986 | European Pat. Off. | 164/306 |
| 0398168 | 11/1990 | European Pat. Off. . | |
| 58-221655 | 12/1983 | Japan | 164/306 |
| 5-138330 | 6/1993 | Japan | 164/306 |
| 2047140 | 11/1980 | United Kingdom . | |

*Primary Examiner*—J. Reed Batten, Jr.
*Attorney, Agent, or Firm*—Low and Low

[57] ABSTRACT

The casting plant includes dual independent casting workstations which sequentially interact with a common core inserting station, the dual workstations include casting removal stations, cooling and blackwash stations, and casting die travelling and manipulating units. The several workstations are compactly arranged, whereby only one operator is needed for core inserting and cleaning of the die halves. Each set of workstations may operate independently of the other set.

7 Claims, 7 Drawing Sheets

LOW-PRESSURE DIE CASTING PLANT

BACKGROUND OF THE INVENTION

Low-pressure die casting apparatus is generally well known in the art. The same often embrace single-station casting dies with manual or automatic removal of the cast product for further handling. Such known apparatus does not provide for relatively high speed production or single operator control of plural casting units and related transfer equipment.

BRIEF SUMMARY OF THE INVENTION

The present invention relates to a low-pressure die casting plant which permits maximized output from two die casting stations operating sequentially.

The entire casting plant is composed of two plant parts which have a common core inserting station and which can thus be operated by a single operator. Consequently, although the two plant parts have to be coordinated with one another in the operating cycle, they can otherwise be operated independently of one another.

The special arrangement of the workstations along the linear paths of movement of the manipulating units results in short travels of the latter between the associated workstations, thus allowing relatively high productivity.

The dual system further embraces cooperating traveling units for the manipulating units which are guided along at least one overhead girder associated with quadrilateral pillars forming the carrying stand, and a movable cleaning appliance for the dies which is operative when the manipulating units are respectively at the single core inserting station. Further, the dies in addition to being movable toward and from each other, are also pivotable about their respective pivot axes to facilitate workstation operations.

BRIEF DESCRIPTION OF THE DRAWINGS

An exemplary embodiment of the subject of the invention is explained below with reference to the purely diagrammatic drawings in which.

DESCRIPTION OF THE PREFERRED EMBODIMENT

Figure 1:
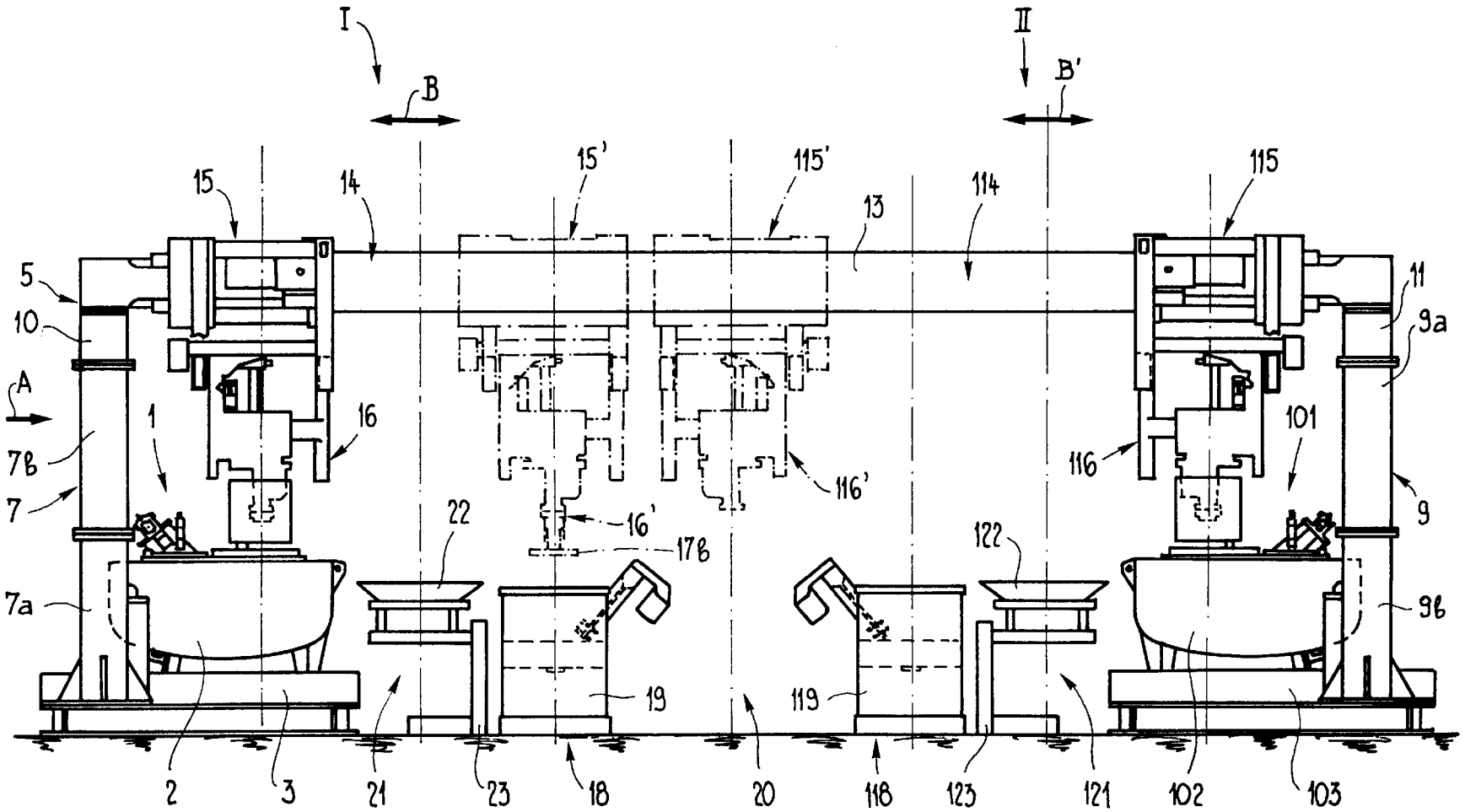
FIGS. 1 and 2 show respectively a side view and a top view of a low-pressure die casting plant composed of two plant parts.
Figure 2:
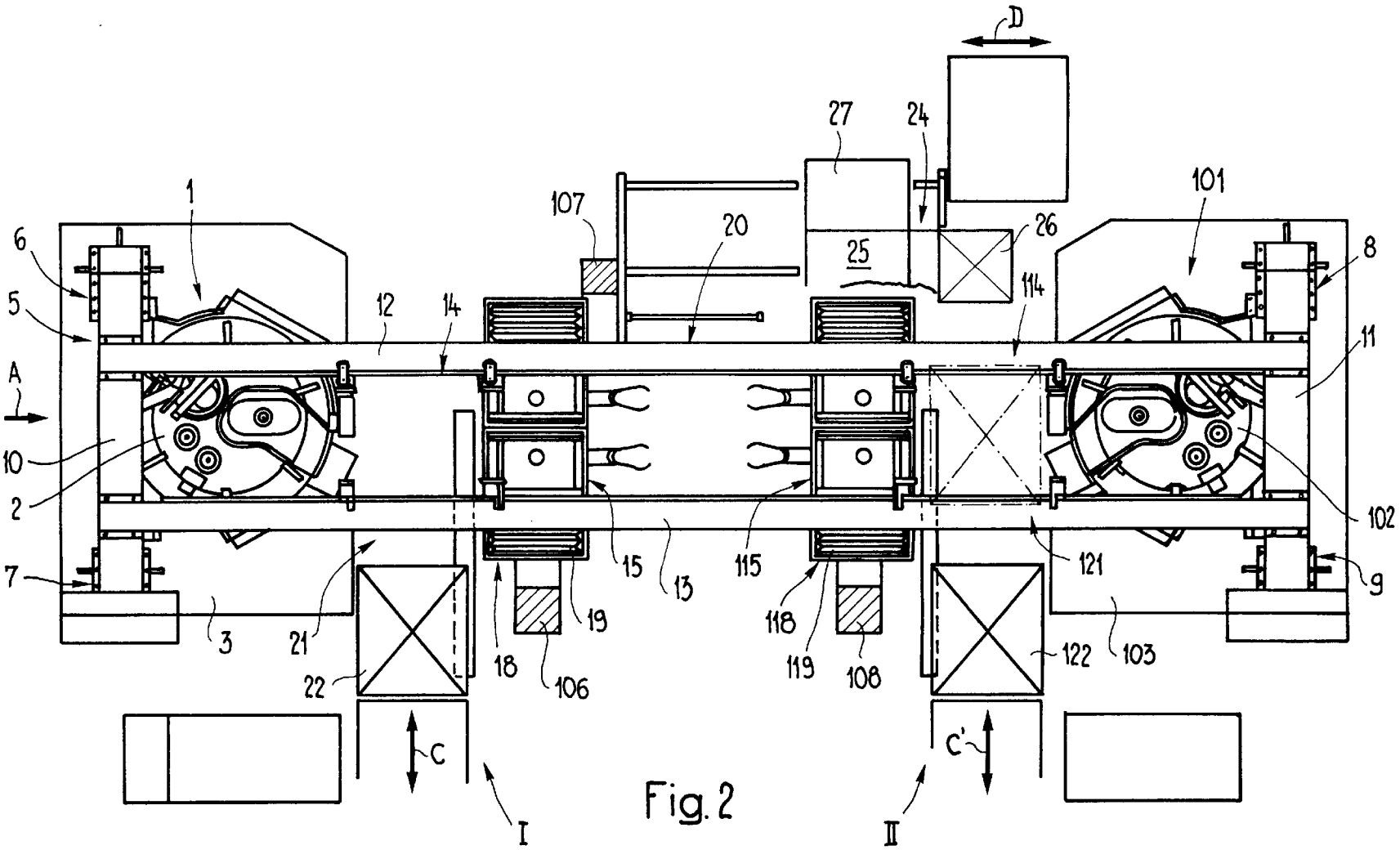

Of the overall dual low-pressure die casting plant shown in side view and in top view in FIGS. 1 and 2 respectively and which is composed of two separate plant parts I and II generally facing each other, FIGS. 3 to 7 illustrate the individual workstations of only the plant part I in a view in the direction of the arrow A in FIGS. 1 and 2. For a clearer understanding, the workstations located, as seen in this direction A, in front of the workstation particularly shown in each case are not shown.

As emerges particularly from FIGS. 1 and 2, the low-pressure die casting plant composed of two plant parts I and II has two casting stations 1, 101 arranged at a distance from one another, each with a melting furnace 2, 102 which is arranged on a carrying structure 3, 103. The carrying structures 3, 103, not shown in FIGS. 3 to 7, are supported on the foundry floor 4. The plant also includes a carrying stand 5 which has four vertical pillars 6, 7, 8, 9. All these pillars 6 to 9 are composed of two pillar parts 6*a*, 6*b*, 7*a*, 7*b* and 9*a*, 9*b* which are screwed to one another. The front pillar 6 on the left, as seen in the direction of the arrow A, is angled in the upper part, as is evident particularly from FIG. 3. The longitudinal axis of the upper pillar part 6*b* forms an angle with the vertical longitudinal axis of the lower pillar part 6*a*. This design of the front pillar 6 makes it possible to take into account the greater width of the melting furnace 2, without the entire casting plant having to be constructed so as to be wider than necessary. By subdividing the pillars 6 to 9 into two pillar parts capable of being screwed to one another, it is possible to dismantle the plant into individual units which can be transported without serious problems. The pillars 6, 7, 8 and 9 stand on the carrying structures 3, 103 on the foundry floor 4.

A transverse girder 10, 11 rests in each case on the pillars 6, 7 and 8, 9 and is connected to the associated pillars 6, 7 and 8, 9. Two longitudinal girders 12, 13 are supported on these transverse girders 10,11 and run at a distance from and are parallel to one another. These longitudinal girders 12, 13 define a rectilinear path of movement 14, 114 for a traveling unit 15, 115. Fastened to this traveling unit 15, 115 is a manipulating unit 16, 116 which in each case carries a die 17, the die halves of which are designed by 17*a* and 17*b* (see, in particular FIGS. 3 to 7). The die fastened to the manipulating unit 116 is not illustrated in FIGS. 1 and 2.

The more precise design of the two identical manipulating units 16 and 116 will be explained in more detail later with reference to FIGS. 3 to 7. By means of the traveling units 15, 115, the manipulating units 16 and 116 are moved to and fro in the direction of the arrow B, B' along the linear path of movement 14, 114, that is to say the longitudinal direction of the longitudinal girders 12, 13. The carrying stand 5 has, furthermore, three pillars 106, 107 and 108 which are not shown in FIG. 1.

A number of further workstations, which lie below the paths of movement 14 and 114 of the travelling units 15 and 115, are arranged in a row between the two casting stations 1 and 101. Adjacent to each casting station 1, 101 is an removal station 21, 121, at which the castings are led away to one side. This purpose is served by a leadaway table 22, 122 which can be moved in the direction of the arrow C, C' (FIG. 2) along a guide 23, 123 (FIG. 1). Instead of such a leadaway table 22, 122, a gripper device may also be provided for grasping the castings and leading them away. Adjacent to each removal station 21, 121 is a cooling and blackwash station 18, 118 which has a blackwash bath 19, 119. Located between the two cooling and blackwash stations 18, 118 is a core inserting station 20 which is common to the two plant parts I and II. The travelling unit 15 together with the manipulating unit 16 moves between the casting station 1 and the core inserting station 20, whilst the other traveling unit 115 together with the manipulating unit 116 travels to and fro between the casting station 101 and the core inserting station 20.

Furthermore, as emerges from FIG. 2, a cleaning appliance 24, which serves for periodically cleaning the die halves 17*a*, 17*b*, is provided. This cleaning appliance 24 has a cleaning booth 25 which is designed as a sandblasting booth in the present exemplary embodiment. The cleaning appliance 24 also includes a filter 26 and a platform 27. The cleaning appliance 24 can be displaced in translational motion in the direction of the arrow D, so that it can be brought out of the standby position shown in FIG. 2 into the working position. In this working position, the cleaning appliance 24 is at the location of the core inserting station 20.

The design of the manipulating unit 16 is now described with reference to FIGS. 3 to 7. The other manipulating unit 116 is designed identically to the manipulating unit 16. However, in these FIGS. 3 to 7, the latter is shown only purely diagrammatically and is illustrated only in so far that its mode of operation can be recognized.

The manipulating unit 16 has a carrying structure 30 connected to the travelling unit 15. The carrying structure 30 can be raised and lowered in the direction of the arrow E. An elongate guide element 31 is pivotably mounted in the carrying structure 30. The pivot axis 32 of the guide element 31 runs parallel to the direction of the movement B of the travelling unit 15. Two mounting elements 33 and 34 project away from the guide element 31, one mounting element 33 being mounted fixedly and the other mounting element 34 being mounted so as to be displaceably linearly in the direction of the arrow F. A carrying arm 35, 36 is pivotably connected to each mounting element 33, 34. The pivot axes 37 and 38 of the carrying arms 35 and 36 likewise run parallel to the direction of movement B of the traveling unit 15 and are therefore parallel to the pivot axis 32 of the guide element 31. The die halves 17*a* and 17*b* are fastened to these carrying arms 35, 36. In the casting position of the die 17, shown in FIG. 3, the mold parting plane 39 lies in a vertical plane which runs parallel to the direction of movement B of the traveling unit 15 and of the manipulating unit 16 (FIG. 3).

The mode of operation of the plant part I of the low-pressure die casting plant is now explained in more detail with reference to FIGS. 3 to 7.

Figure 3:
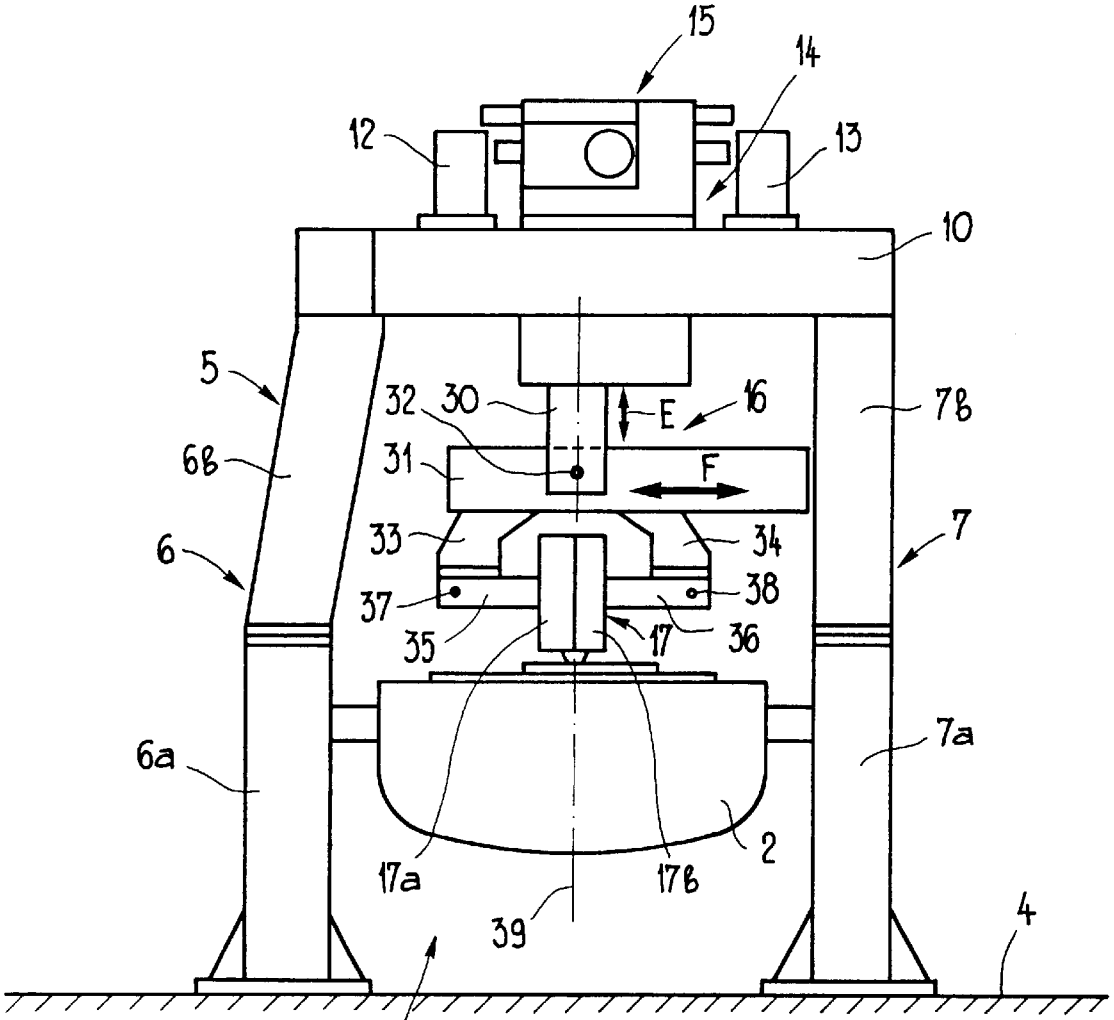
FIGS. 3 to 7 show the individual workstations of one plant part in a view in the direction of the arrow A in FIGS. 1 and 2.

In FIG. 3 (and on the left in FIG. 1), the manipulating unit 16 is shown in its one, first end position, in which it is located in the casting station 1. The closed die 17 is located on the casting mouth of the melting furnace 2. The die is filled with liquid metal in a known way. At the same time, by controlling the pressure profile in the melting furnace 2, the filling operation is adapted to the design of the casting to be produced.

Figure 4:
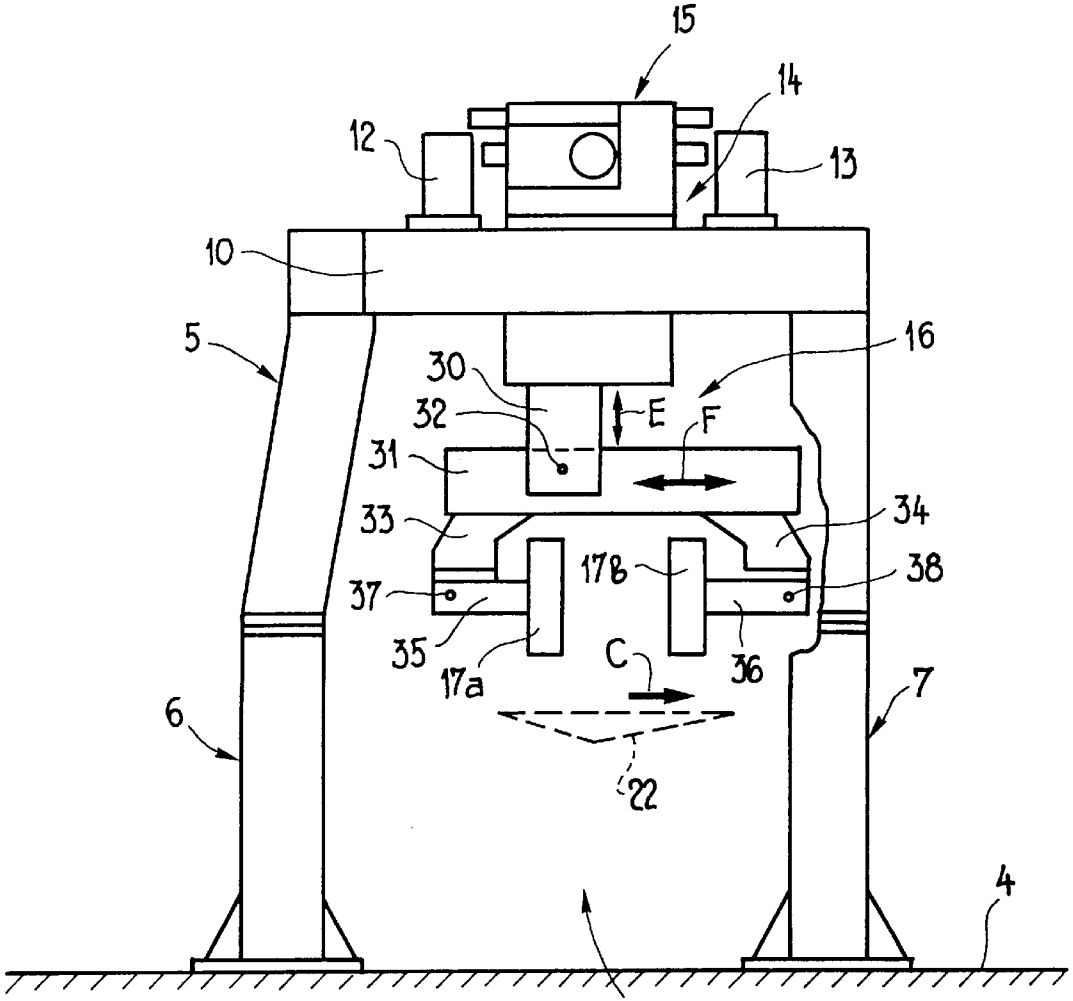

After the casting operation has ended, the filled die 17 is lifted off from the casting mouth as a result of an upward movement of the carrying structure 30 in the direction of the arrow E. The traveling unit 15 is then moved, together with the manipulating unit 16, into a first intermediate position, that is to say into the removal station 21. When the manipulating unit 16 is located in the removal station 21, the die 17 is opened (see FIG. 4). This takes place as a result of movement of the mounting element 34 outward in the direction of the arrow F. At the same time, the die half 17*b* is moved away from the die half 17*a*. By means of ejectors (not shown) arranged in the carrying arms 35, 36, the finished casting is ejected from the mold and falls onto the leadaway table 22 which, as shown in FIG. 4, is located underneath the open die 17. The leadaway table 22 is subsequently moved outward, that is to say out of the removal station 21, in the direction of the arrow C. If an removal gripper is used instead of such a leadaway table 22, said gripper grasps the casting and conveys the latter out of the open die 17. As soon as the leadaway table 22 is unloaded, it moves back into the loading position again.

Figure 5:
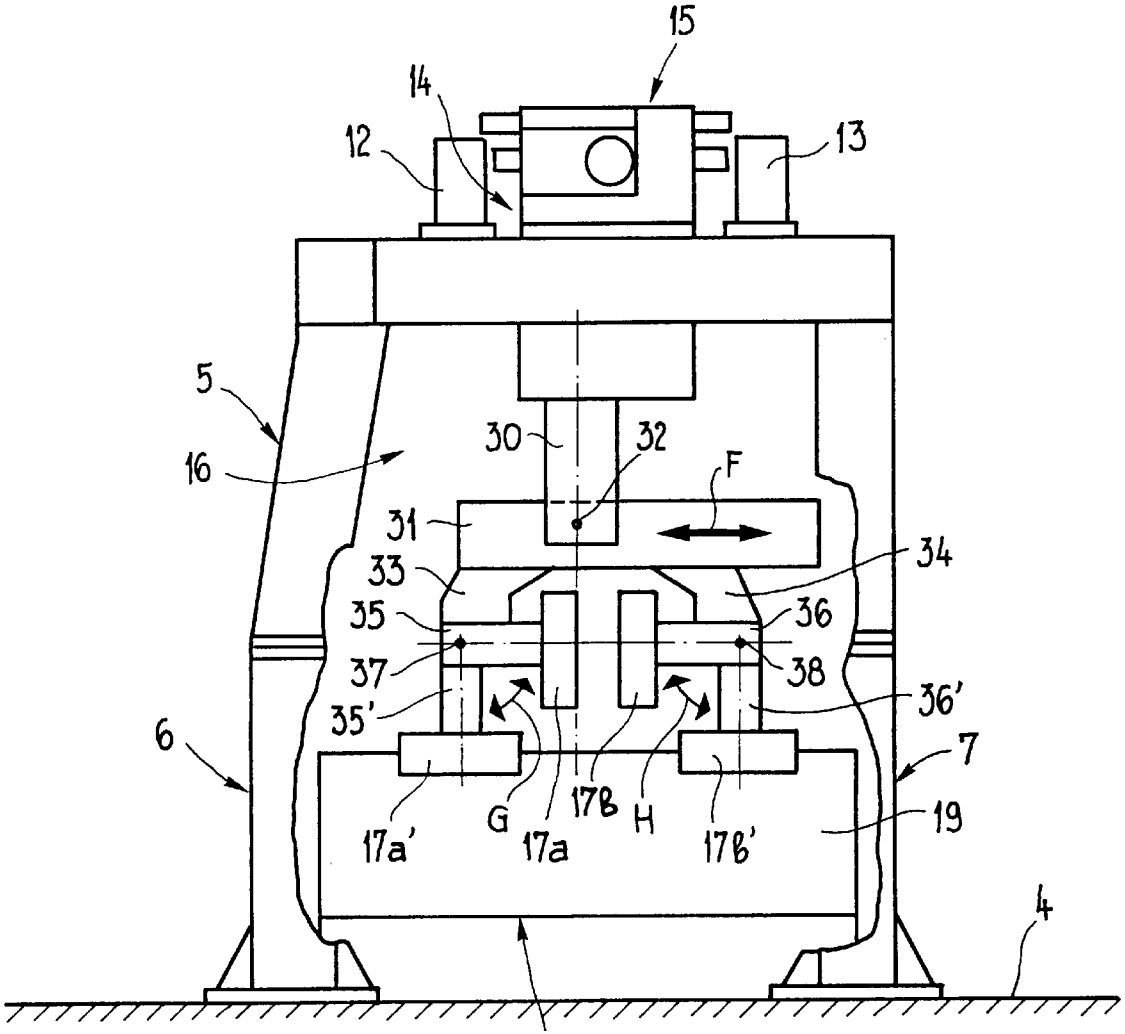
Figure 6:
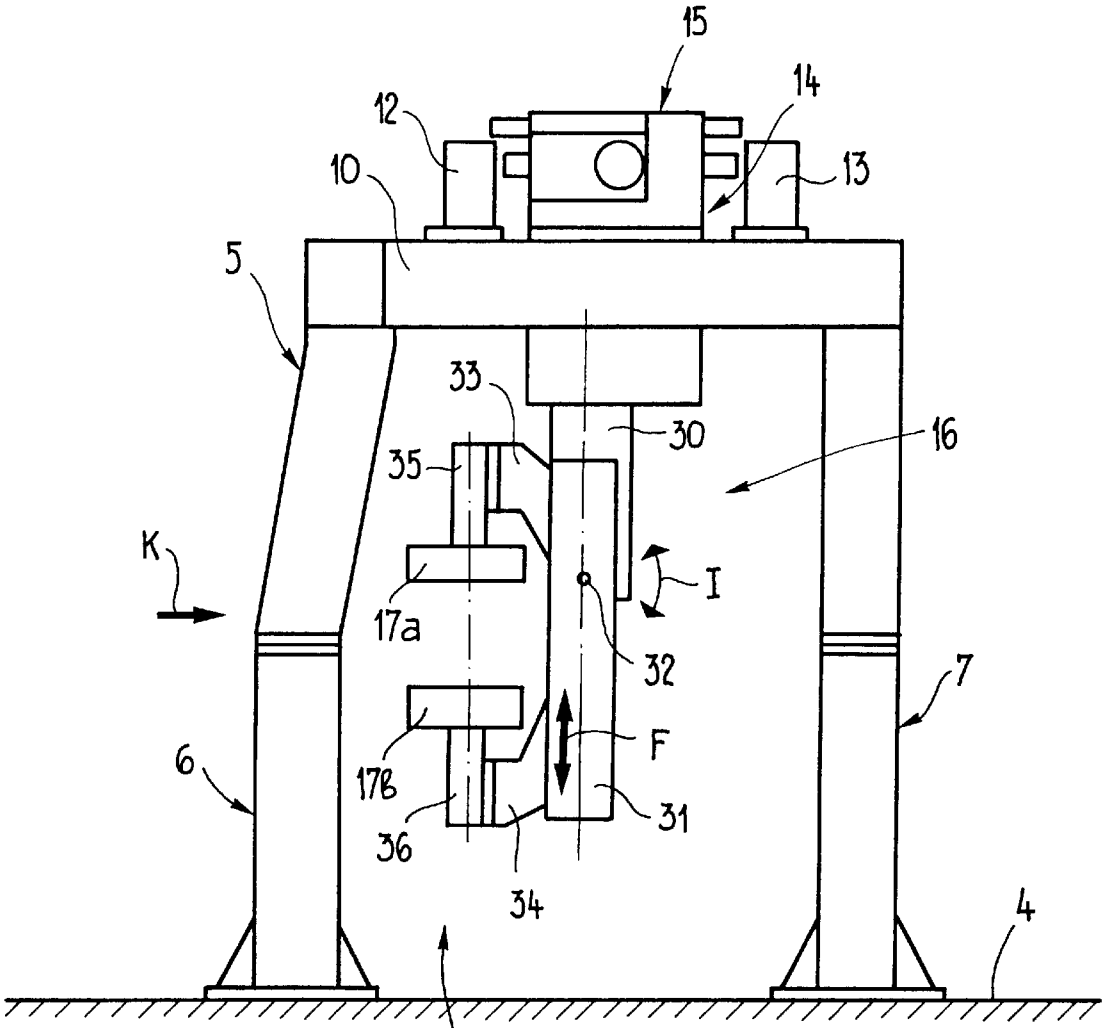

The manipulating unit 16 is subsequently moved into a second intermediate position, that is to say into the cooling and blackwash station 18, by means of the traveling unit 15. In FIG. 1, the traveling unit and the manipulating unit which are located in this second intermediate position are designated by 15' and 16' respectively. FIG. 5 shows the manipulating unit 16 located in the cooling and blackwash station 18. The two die halves 17*a* and 17*b*, still located opposite one another, are moved apart somewhat and are then dipped into the blackwash bath 19 by pivoting the carrying arms 35 and 36 about the pivot axes 37 and 38 in the direction of the arrows G and H respectively. The die halves dipped into the blackwash bath 19 are designated by 17*a*' and 17*b*'. In the blackwash bath 19, the die halves 17*a*', 17*b*' are cooled to the optimal temperature and are covered with a blackwash film. The carrying arms 35 and 36 are then pivoted back again about their pivot axes 37 and 38 in the direction of the arrows G and H, until they assume their horizontal end position and the die halves 17*a* and 17*b* are once more located opposite one another. The traveling unit 15 travels further into the second end position, that is to say into the core inserting station 20. The die halves 17*a* and 17*b* are moved apart as far as necessary by displacing the mounting element 34 in the direction of the arrow F. The guide element 31 is simultaneously pivoted through 90° about its pivot axis 32 in the direction of the arrow I. In this case, as shown in FIG. 6, the guide element 31 assumes a vertical position, whilst the die halves 17*a*, 17*b* assume a horizontal position. The core is set into the open die 17 from the side on the left in FIG. 6, as indicated by the arrow designated by K. After the inserting of the core has taken place, the die 17 is closed by moving back the mounting element 34, and the guide element 31 is pivoted back into the horizontal position about its pivot axis 32 in the direction of the arrow I. The traveling unit 15 then moves the manipulating unit 16 back again into the first end position, that is to say into the casting station 1. In this, the die 17 is placed onto the casting mouth of the melting furnace 2 by lowering the carrying structure 30 in the direction of the arrow E. The cycle described begins anew once again.

The mode of operation of the other plant part II is, in principle, the same as described above with reference to the plant part I. The manipulating unit 116 is moved out of the first end position, in which it is located in the casting station 101, into the first intermediate position (removal station 121), then into the second intermediate position (cooling and blackwash station 118) and finally into the second end position (core inserting station 20), in order then to be moved back into the first end position again. Since the core inserting station 20 is common to the two plant parts I and II, the operating cycles of the two plant parts I and II are shifted relative to one another in time. When the second manipulating unit, as illustrated by dashed lines in FIG. 1 and as designated by 116', is located in the second end position (core inserting station 20), the first manipulating unit 16 is located in its first end position (casting station 1) or already in the first intermediate position (removal station 21). In other words, the casting operation takes place in each case in one plant part I or II, whilst, in the other plant part II or I, a new core is set into the die halves in the core inserting station 20.

Figure 7:
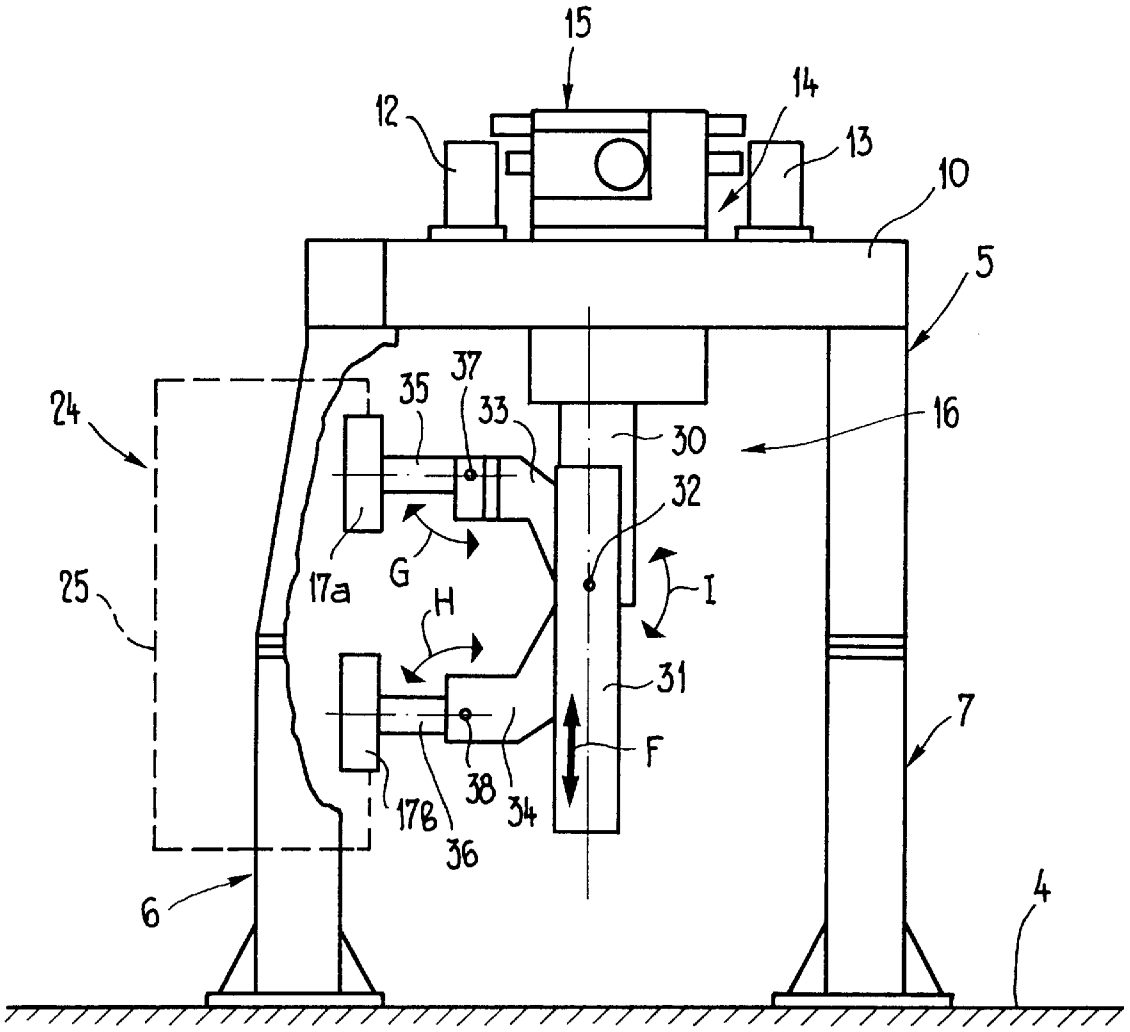

After a specific number of work cycles, it is necessary to clean the die halves 17*a*, 17*b*. For this purpose, when the manipulating unit 16 or 116 is located in the core inserting station 20, after a casting has been extracted the guide element 31 is pivoted clockwise about its pivot axis 32 in the direction of the arrow I, so that the die halves 17*a*, 17*b* are directed towards the tending side for core inserting. The carrying arms 35, 36 are pivoted into a horizontal position about their pivot axes 37, 38 in the direction of the arrows G and H. The two die halves 17*a*, 17*b* are then accessible from the plant side on the left in the direction of the arrow A, as shown in FIG. 7. The cleaning appliance 24 is then displaced from the standby position shown in FIG. 2 into the working position. The die halves 17*a,* 17*b* then project into the cleaning booth 25 and are cleaned by sandblasting. After cleaning has ended, the cleaning appliance 24 is displaced back into the standby position again. The manipulating unit 16 or 116 is moved to the cooling and blackwash station 18 or 118 by the traveling unit 15 or 115. Moreover, the guide element 31 is pivoted into the horizontal position about the axis 32 once again. As described with reference to FIG. 5, the die halves 17*a,* 17*b* are dipped into the blackwash bath 19, 119 and are covered with a blackwash film. The work cycle explained above can then continue (core inserting, casting, casting removal, cooling and covering of the die halves with a blackwash film).

The individual parts of the manipulating units are preferably actuated by means of hydraulic drives. The traveling units 15, 115 are advantageously moved by means of an electric drive.

The two plant parts I and II may be operated independently of one another, that is to say castings composed of different materials may be produced simultaneously by means of the plant according to the invention. Nevertheless, the amount of space required is relatively small, because, by virtue of the special arrangement of the workstations, core inserting for both plant halves can take place at the same location. Only one operator is required for core inserting and for cleaning the die halves.

The selected arrangement of the various workstations results in short travels of the traveling units 15 and 115 and of the manipulating units 16 and 116. These two units 15, 16 and 115, 116 move from a first end position into a first intermediate position, from this into a second intermediate position, then into a second end position and subsequently back into the first end position.

I claim:

1. A low-pressure die casting plant with two casting stations (1, 101) arranged at a distance from one another and each having a melting furnace (2, 102), with a number of further workstations arranged in a row between the two casting stations (1, 101), namely two removal stations (21, 121) for castings, said removal stations being adjacent in each case to one of the two casting stations (1, 101), two cooling and blackwash stations (18, 118) adjacent in each case to one of the two removal stations (21, 121), and a core inserting station (20) arranged between the two cooling and blackwash stations (18, 118), and with two manipulating units (16, 116) which in each case carry two die halves (17*a,* 17*b*) and each of which can be moved to and fro along a linear path of movement (14, 114), running above the casting stations (1, 101) and the further workstations (18, 20, 21, 118, 121), between a first end position, in which it is located in the associated casting station (1, 101), and a second end position, in which it is located in the core inserting station (20), and can be stopped in intermediate positions, located between the end positions, in the associated removal station (21, 121) and the associated cooling and blackwash station (18, 118), the two die halves (17*a,* 17*b*) of the manipulating units (16, 116) being arranged on the respectively associated manipulating unit (16, 116) in such a way that, in the casting position of the die (17), the mold parting plane (39) lies in a vertical plane parallel to the direction of movement (B, B') of the corresponding manipulating unit (16, 116).

2. The plant as claimed in claim 1, wherein each manipulating unit (16, 116) is mounted on a traveling unit (15, 115) which is guided so as to be movable along at least one longitudinal girder (12, 13) supported on a carrying stand (5).

3. The plant as claimed in claim 1, wherein there is a cleaning appliance (24) for the dies (17), which cleaning appliance can be brought from a standby position into a working position, in which the die halves (17*a,* 17*b*) are cleaned when the manipulating unit (16, 116) is located in the core inserting station (20).

4. The plant as claimed in claim 1, wherein the die halves (17*a,* 17*b*) can be moved toward and away from one another and are mounted in the associated manipulating unit (16, 116) so as to be pivotable in each case through 90° about a common pivot axis (32) which runs parallel to the direction of movement (B, B') of said manipulating unit (16, 116).

5. The plant as claimed in claim 4, wherein each die half (17*a,* 17*b*) is additionally pivotable, in each case through 90° about its own pivot axis (37, 38) which runs parallel to the direction of movement (B, B') of the associated manipulating unit (16, 116).

6. The plant as claimed in claim 2, wherein the carrying stand (5) has four pillars (6, 7, 8, 9) which are arranged at the corners of a quadrilateral and which are connected to one another in pairs, in each case by means of a transverse girder (10, 11), and wherein at least one longitudinal girder (12, 13) is supported on the transverse girders (10, 11), said longitudinal girder extending approximately at right angles to these.

7. The plant as claimed in claim 1, wherein each of the two cooling and blackwash stations (18, 118) has a blackwash bath (19, 119).

* * * * *